United States Patent [19]

Shiono et al.

[11] Patent Number: 4,769,117

[45] Date of Patent: Sep. 6, 1988

[54] BARREL PLATING APPARATUS

[75] Inventors: Kiichi Shiono, Fujiidera; Keizou Nakagawa, Yamato-Takada, both of Japan

[73] Assignee: Uyemura Kogyo Kabushiki Kaisha, Osaka, Japan

[21] Appl. No.: 858,669

[22] Filed: May 2, 1986

[51] Int. Cl.[4] ..... C25D 17/24; B05C 3/08

[52] U.S. Cl. ..... 204/214; 118/418; 118/425

[58] Field of Search ..... 118/418, 425; 134/159; 204/213, 214

[56] References Cited

U.S. PATENT DOCUMENTS

| | | | |
|---|---|---|---|
| 3,382,844 | 5/1968 | Kumpf | 118/418 X |
| 4,252,229 | 2/1981 | Corbett | 118/425 X |
| 4,268,206 | 5/1981 | Johnson | 118/425 |

*Primary Examiner*—Evan K. Lawrence
*Attorney, Agent, or Firm*—Bradford E. Kile

[57] ABSTRACT

A barrel plating apparatus in which a barrel accommodating a large number of works is successively soaked in a plurality of baths filled with treatment liquid, the barrel comprising a peripheral wall, a pair of end walls at opposite ends of the peripherial wall, an opening provided at a central portion of the end wall without a cover or a cap, and a space for accommodating the works which is formed by a space lower than the opening inside the barrel when the central longitudinal axis of the barrel is horizontal. The apparatus comprises a holding mechanism for holding the barrel, a supporting mechanism capable of supporting and moving the holding mechanism between the inclined and horizontal positions in which said center line is inclined and horizontal, respectively, a transferring mechanism for horizontally transferring the supporting mechanism, a lifting mechanism for vertically moving the supporting mechanism, a rotating mechanism for rotating the barrel in a treating position, and an inclining mechanism for inclining the holding mechanism and the barrel in an unloading position for unloading the works from the barrel.

6 Claims, 4 Drawing Sheets

BARREL PLATING APPARATUS

BACKGROUND OF THE INVENTION

The present invention relates to a barrel plating apparatus, in which a large number of works are accommodated in barrels when they are plated.

In a barrel of a plating apparatus, as disclosed in Japanese utility model publication No. 61-336, a cover or cap is detachably provided over an opening for charging and discharging works. Therefore, it is necessary to detach and reattach the cover by a manual operation for charging the works into the barrel and discharging them. This is a primary reason why a series of the plating operations can not be fully automated.

Japanese utility model, laid-open publication No. 51-174500, discloses a barrel including an opening without a cover. However, this barrel must be swung through an angle smaller than 180 degrees and the opening must always be directed upwardly or obliquely upwardly during the treating operation so as to prevent the works from discharging from the barrel. Therefore, a stirring efficiency of such a barrel of the swing type is less than that of a conventional rotating barrel, so that a long time is required for the plating operation in the swing barrel.

Accordingly, it is an object of the invention to provide an improved plating apparatus, overcoming the above-noted disadvantages, in which a barrel of a rotating type without a cover is employed.

SUMMARY OF THE INVENTION

The present invention is to provide a barrel plating apparatus in which a barrel accommodating a large number of works is successively soaked in a plurality of baths filled with treatment liquid, said barrel comprising a peripheral wall, a pair of end walls at opposite ends of the peripheral wall, an opening provided at a central portion of at least one end wall without a cover or a cap, and a space for accommodating the works which is formed by a space lower than the opening inside the barrel when a center line of the barrel is horizontal, and said apparatus comprising a holding mechanism for holding the barrel, a supporting mechanism capable of supporting and moving the holding mechanism between the inclined and horizontal positions in which said center line is inclined and horizontal, respectively, a transferring mechanism for horizontally transferring the supporting mechanism, a lifting mechanism for vertically moving the supporting mechanism, a rotating mechanism for rotating the barrel in a treating position, and an inclining mechanism for inclining the holding mechanism and the barrel in an unloading position for unloading the works from the barrel.

Other and further objects, features and advantages of the invention will appear more fully from the following description of the preferred embodiments of the invention.

DETAILED DESCRIPTION OF THE PREFERRED EMBODIMENT

Figures 1, 2, 3, 4:
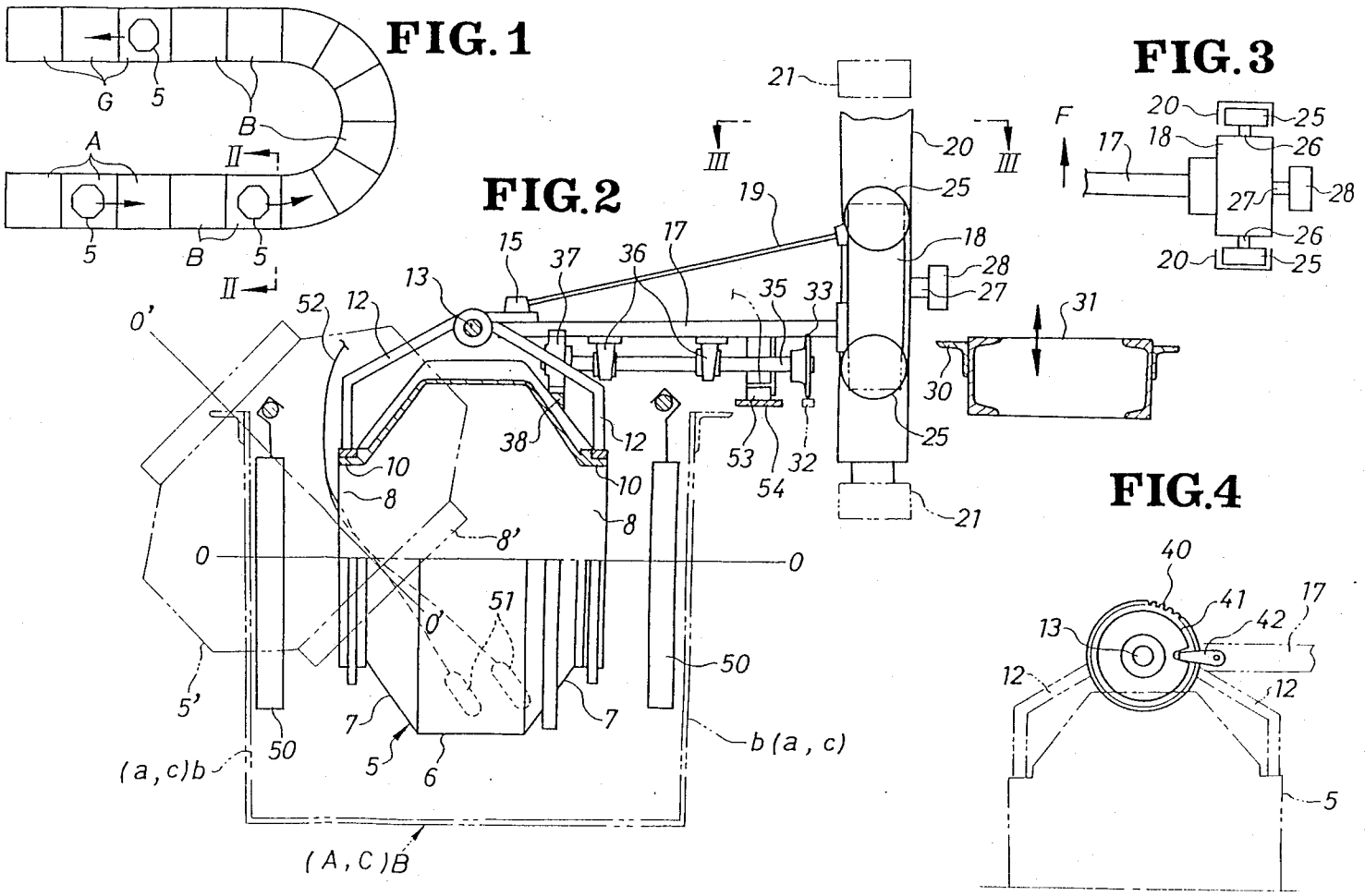
FIG. 1 is a schematic plan view of treating baths.
FIG. 2 is a partially cut-away elevation view of an embodiment of the invention taken along line II—II in FIG. 1.
FIG. 3 is a schematic sectional view taken along line III—III in FIG. 2.
FIG. 4 is a fragmentary sectional view of an inclining mechanism.

Referring to FIG. 1, pre-treatment baths A, plating baths B and after-treatment baths C are arranged in series on a floor. A large number of small works (not shown) are accommodated in barrels 5 (only some of them are illustrated) and are successively soaked in the baths A, B and C.

Referring to FIG. 2, the barrel 5 is made from plastics such as chloroethene and includes a cylindrical peripheral wall 6 and a pair of tapered end walls 7 provided at opposite ends of the wall 6. The end walls 7 are provided at the central portions with openings 8 of a large diameter. The openings 8 are surrounded by cylindrical portions 10 of the walls 7, of which outer peripheries are rotatably held by a pair of arms 12 (holding mechanism), respectively. The barrel 5 held by the arms 12 is rotatable in a horizontal position around a center line or central longitudinal axis 0—0 of the barrel 5. In a treating position of the barrel 5 illustrated in solid lines, the center line 0—0 is perpendicular to vertical side walls b (a, c) of the baths B (A, C).

The upper ends of the arms 12 above the barrel 5 are rigidly fixed to a common horizontal support shaft 13, which is pependicular to the barrel center line 0—0 and is supported by a free end of an arm 17 (supporting mechanism) through a bearing and a bracket 15. The arm 17 extends horizontally and perpendicularly to the support shaft 13. The base end of the arm 17 is projected sideways beyond the baths B (A, C), and the projected base end is rigidly fixed to a lower portion of a frame 18. A reinforcement arm 19 which connects the bracket 15 to the frame 18 is disposed above the arm 17. The frame 18 is vertically movably mounted on a pair of vertical columns 20 (only one of them is illustrated in FIG. 2), as will be detailed later. When the columns 20 are moved horizontally along the side wall b (a, c) by a transferring mechanism described below, the frame 18, arms 17 and 12 and the barrel 5 moves together with the columns 20 in the same direction.

The transferring mechanism includes chains 21 extending horizontally along the side wall b (c, a), sprockets and a motor (respectively not shown) for guiding and driving the chains 21. The columns 20 are connected at the upper and lower ends to the chains 21 and can move together with the chains 21.

As shown in FIG. 3, an arrow F indicates a moving direction of the columns 20, i.e., a transferring direction of the barrel. The columns 20 are arranged in front of and at the rear of the frame 18. Guide rollers 25 operable to vertically move in guide grooves in the columns 20 are rotatably supported by the frame 18 by means of horizontal shafts 26 which are perpendicular to the arm 17. As shown in FIG. 2, the rollers 25 are arranged at the upper and lower portions of the frame 18. A roller 28 is rotatably supported by a horizontal shaft 27 on the rear side opposite to the arm 17 of the frame 18. The roller 28 is adapted to be pushed upwardly by a rail of a lifting mechanism so that the arms 17 and 12 and the barrel 5 may be moved upwardly together with the frame 18.

The lifting mechanism includes a beam 31 which extends in the transferring direction F at the vicinity of the roller 28. The beam 31 is adapted to be vertically moved by a driving mechanism (not shown). Said rail 30 is provided on an upper portion at each side of the substantially whole length of the beam 31. As apparent from the above description, the beam 31 can be moved vertically so as to adjust the vertical position of the arm 17 and the barrel 5 through the rail 30, roller 28 and others. The frame 18 and the barrel 5 which are lifted above the baths B (A, C) can be transferred horizontally by the chains 21, in which case the roller 28 rolls on the rail 30. The beam 31 and the rails 30 are formed by long members so that the many barrels 5 can be lifted simultaneously.

A chain 32 parallel to the chain 21 is arranged under the base end of the arm 17. The chain 32 forms a part of a barrel rotating mechanism, and is guided and driven by sprockets and a motor (respectively not shown) on a stationary frame. A sprocket 33 engaging with the chain 32 is arranged above the chain 32 and is fixed to an end of a drive shaft 35 parallel to the arm 17. The shaft 35 is supported by bearings 36 provided on the lower surface of the arm 17. A spur gear 37 is fixed to other end of the shaft 35 above the barrel 5. A gear 38 meshing with the gear 37 is fixed to the peripheral surface of one of the tapered end walls 7 of the barrel 5 and is arranged concentrically to the center line 0—0 thereof. The chain 32 can drive the gear 38 through the sprocket 33, the shaft 35 and the gear 37 so that the barrel 5 may be rotated around the center line 0—0.

As shown in FIG. 4, said horizontal support shaft 13 has an extended portion to which a gear 40 and a recessed circular cam 41 of an inclining mechanism are rigidly fixed. The inclining mechanism further includes a stopper 42 disposed on the arm 17 or a member fixed thereto. The stopper 42 is adapted to be driven by a toggle mechanism or a pneumatic cylinder mechanism (not shown). In an unloading or discharging operation, the stopper 42 engages, as shown in FIG. 4, with the recess of the cam 41 to prevent the rotation of the shaft 13, so that the barrel 5 is securely kept in an ordinary position in which the center line 0—0 is horizontal. Although not shown, in an unloading station for unloading the works from the barrels, a gear driving mechanism meshing with the gear 40 is arranged. When the stopper 42 is disengaged from the cam 41 and that mechanism drives the gear 40 to turn the shaft 13 in the unloading station, the arms 12 and the barrel 5 incline as illustrated in phantom lines in FIG. 2 so that one of the openings 8' is directed obliquely downward. In the unloading station, the arm 17 and the barrel 5 occupy a high position. A mechanism for driving the sprocket 33 in the high position is provided in the unloading station.

In a series of the plating operations, said mechanisms are operated to move the barrels 5 as follows. In a loading or charging operation of the works, the barrel 5 is lifted while keeping it horizontal, and a large number of small works are automatically loaded through the opening 8, e.g., at the left in FIG. 2, into the barrel 5 by a part feeder (not shown). The barrel 5 in which the works have been loaded is successively soaked in the pre-treatment baths A, the plating baths B and the after-treatment baths C to perform the plating on the works. The soaking operations of the works into the baths A, B and C are performed by transferring and vertically moving the barrel 5 by the chain 21 and the beam 31. During the treating operations in the baths A, B and C, the chain 32 rotates the barrel 5, as described before, to stir the works. The works are always positioned in a work accommodating space lower than the openings 8 in the barrel 5. In the plating bath B, anodes 50 are arranged in the vicinity of both side walls b. A cathode 51 is arranged in the barrel 5. A feeder wire 52 for the cathode 51 is electrically connected to a feeder rail 54 made of a copper plate through a carbon brush 53 fixed to the arm 17.

The barrel 5 after the after-treatment is raised, and then, is inclined by the gear 40 and others in FIG. 4, as described before. Further, in this raised and inclined position, the barrel 5 is rotated around the inclined center line 0'—0' by the shaft 35, another chain (not shown) and others. By this rotation in the inclined position, the works are efficiently discharged from the inclined barrel 5' through the obliquely downwardly directed opening 8'.

According to the invention, as described hereinbefore, since a cover or a cap is not attached to the openings 8 of the barrel, the loading operation can be automated. Further, since the unloading operation can be performed by inclining the barrel 5, it can also be facilely automated. Further, in the illustrated embodiment, since the inclined barrel 5 is rotated, the unloading operation of the works can further efficiently performed. Moreover, since the barrel 5 is rotated in the baths A, B and C, the time required for the treatment can be shorter than that of the conventional apparatus of the swing type. As stated above, the present invention provides the plating apparatus in which the whole operations can be automated and the treating time can be short.

Figure 5:
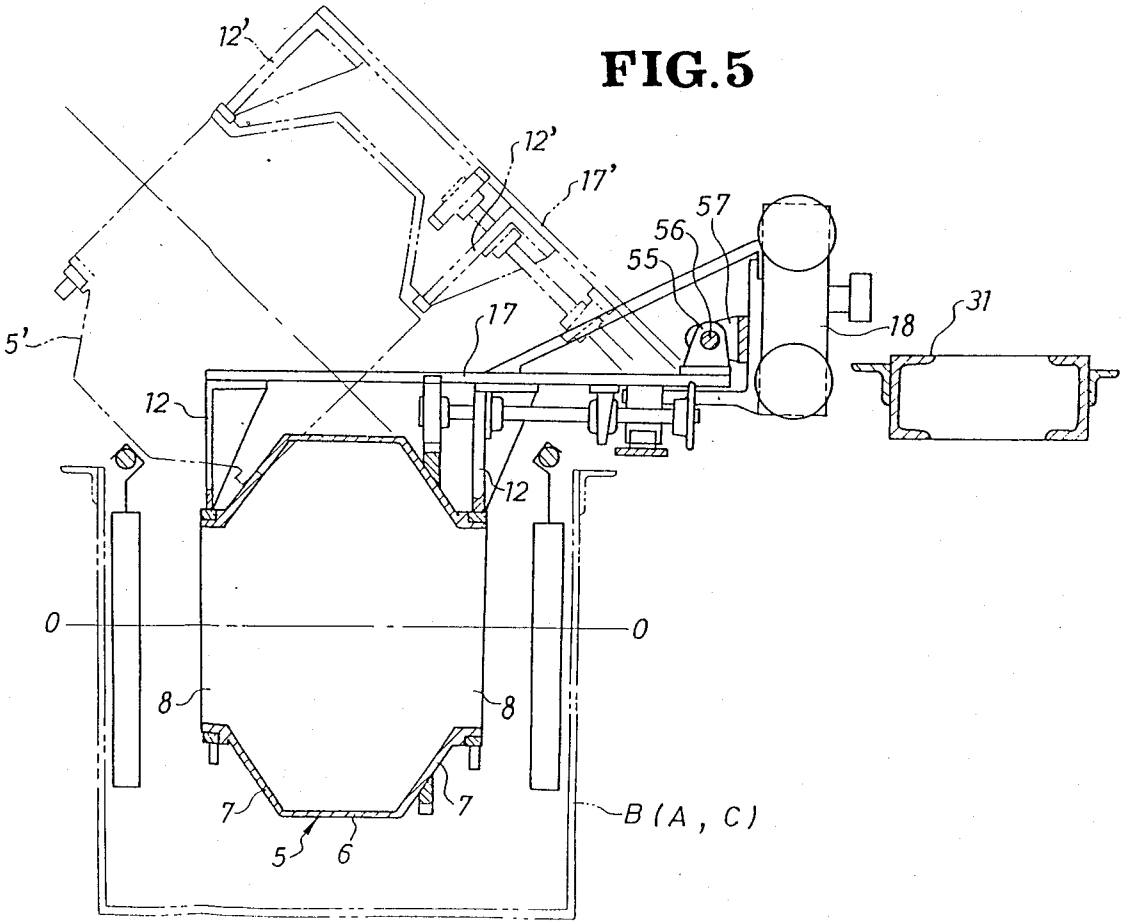
FIG. 5 is a partially cut-away elevation view of another embodiment of the invention.

The present invention can be modified as shown in FIG. 5, in which same or similar members and parts as those in FIG. 2 bear same reference numbers. The apparatus in FIG. 5 is different from that in FIG. 2 in a following structure. In the apparatus in FIG. 5, the arms 12 supporting the barrel 5 are rigidly fixed to the arm 17. The arm 17 is provided at the base end with a bracket 55, which is rotatably connected to a bracket 57 on the frame 18 through a horizontal support shaft 56 perpendicular to the horizontal arm 17.

In this structure, the arm 17 is turned obliquely upwardly to a position indicated by a numeral 17' around the support shaft 56, so that the arms 17' and 12' as well as the barrel 5' are inclined. This inclining operation is performed by pushing up the arm 17 by a hydraulic cylinder (not shown) installed in the unloading station.

Figure 6:
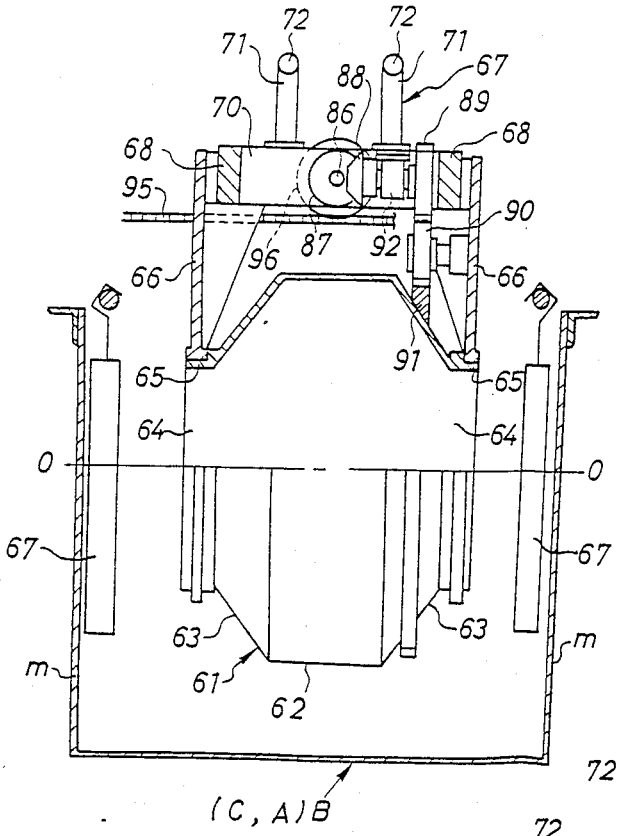
FIG. 6 is a partially cut-away side view of still another embodiment of the invention.
Figure 7:
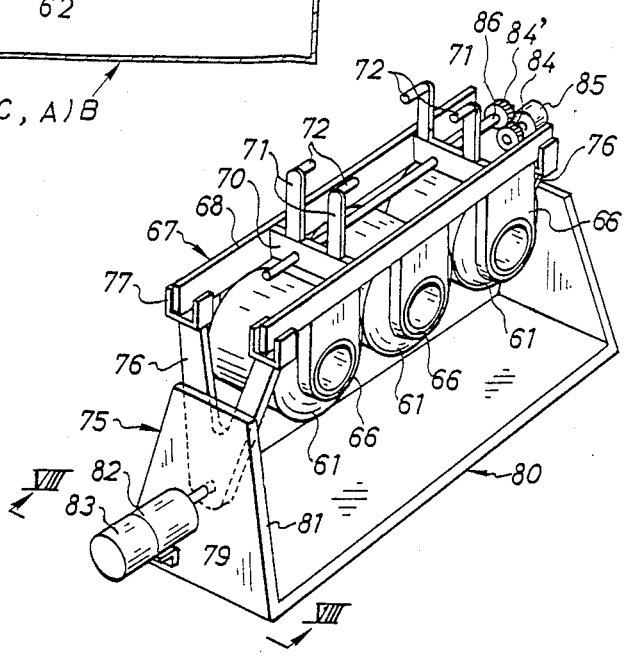
FIG. 7 is a perspective view of the apparatus in FIG. 6 in an unloading station.
Figure 8:
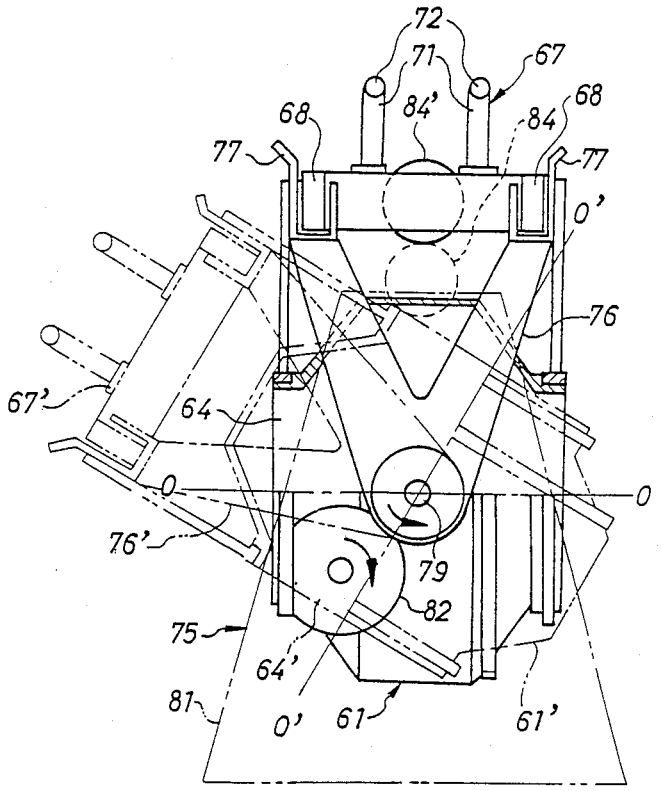
FIG. 8 is a schematic view taken along line VIII—VIII in FIG. 7.

Another modification of the invention is illustrated in FIGS. 6–8. In FIG. 6, the barrel 61 has, similarly to the barrel 5 in FIG. 2, a cylindrical peripheral wall 62 and a pair of tapered end walls 63, which have large openings 64 surrounded by cylindrical end portions 65. As shown in FIG. 7, a carrier bar assembly 67 is designed to support the three barrels 61. A pair of parallel bars 68 of the carrier bar assembly 67 are horizontally arranged above the barrels 61. A pair of arms 66 supporting the cylindrical portions 65 of each barrel 61 are fixed at their upper ends to the bars 68. The arms 66 are provided at the middle portion and both end portions of each bar 68. The bars 68 extend along a partition m of the bath B in FIG. 6, and said three barrels 61 are horizontally aligned along the partition m. As shown in FIG. 7, a pair of the bars 68 are connected together by a pair of cross members 70. A pair of vertical arms 71 are fixed at their lower ends to each member 70. Each arm 71 has at its upper end a hook 72, which is hung by a mobile hanger robot (not shown) to vertically and horizontally, i.e, perpendicularly to the bar 68, move the carrier bar assembly 67 and the barrel 61.

FIG. 7 illustrate a supporting mechanism 75 which supports a carrier bar assembly 67 in an unloading station. The supporting mechanism 75 includes a pair of substantially V-shaped arms 76. The arms 76 are provided at the upper ends with saddles 77, on which the carrier bar assembly 67 lowered together with the barrels by said hanger robot is seated, as illustrated in FIG. 7. The lower ends of the arms 76 are fixed to rotation shafts 79 parallel to the bars 68, respectively. The rotating shafts 79 are rotatably supported by vertical portions 81 of a frame 80. One of the shafts 79 is connected to an output shaft of a motor 83 through a reduction gear mechanism 82. The motor 83 includes a brake (not shown). Thus, the motor 83 can turn and incline the arms 76 through the reduction gear mechanism and the shaft 79, and further, can stationarily hold the arms 76 in the vertical position and the inclined position by the brake.

Referring to FIG. 8, the arms 76 illustrated in solid line occupies the vertical position, and the carrier bar assembly 67 supported by the vertical arms 76 supports the barrels 61 in the horizontal position in which the center line 0—0 is horizontal. The arms 76' illustrated in phantom line are in the incline position. In this position, the carrier bar assembly 67' and the barrels 61' are inclined around the shaft 79, and the openings 64' of the barrels 61' are directed obliquely downwardly. As apparent from the above, the carrier bar assembly 67 is seated on the saddles 77 of the arms 76 in the vertical position, and then, the arms 76 is turned to incline the barrels for discharging the works from the inclined barrels 61' through the openings 64'. In order to sufficiently and efficiently discharge the works, the barrels 61' are rotated around the incline center line 0'—0' by a rotating mechanism, which is provided on the carrier bar assembly 67 and the arm 76.

In FIG. 7, said rotating mechanism includes a motor 85 mounted on the arm 76 remote from the motor 83. An output shaft of the motor 85 is connected through gears 84 and 84' to an end of a rotating shaft 86. The rotating shaft 86 extends parallel to and between the bars 68 and is supported by the members 70 through bearings (not shown). As shown in FIG. 6, bevel gears 87 is fixed to three portions of the shaft 86. The bevel gears 86 are connected through the bevel gears 88, shafts 89, drive spur gears 89 and idle gears 90 to gears 91 on the barrels 61, respectively. Shafts of the gears 88 and 89 are parallel to the center line 0—0, and are supported by bearings 92 on the members 70, respectively. A support shaft of each gear 90 is supported by the arm 66. Each gear 91 is coaxial to the center line 0—0 and is provided on the tapered end wall 63 of the barrel 61. As apparent from the above description, when the shaft 86 is rotated by the motor 85 in FIG. 7, the three barrels 61 are simultaneously rotated by the shaft 86 through the gears.

As shown in FIG. 6, a chain 95 for rotating the shaft 86 is arranged above the baths B (A and C) through the whole length of the bath group. The chain 95 is guided and driven by sprockets and a motor (not shown). When the carrier bar assembly 67 is lowered to the illustrated position for the treatment, a sprocket 96 on the shaft 86 meshes with the chain 95, so that the barrels 61 are rotated in the baths B (A and C).

The barrels 61 are soaked in the baths B (A and C) for predetermined time periods, respectively. During this operation, the bars 68 are supported by saddles (not shown) provided on the side walls of the baths B (A and C). Anodes for the plating are vertically arranged at the vicinity of the partitions m of the baths B. An cathode (not shown) is disposed in each barrel 61.

A series of the treating operations are performed as follows. In the loading station, the carrier bar assembly 67 which horizontally supports the three barrels 61, as shown in FIG. 6, is lifted to a higher position by the hanger robot. In this higher position, a large number of works are loaded through the opening 64 into the barrel 61 by a part feeder (not shown) or the like. Then, the barrels 61 supported by the carrier bar assembly 67 are successively soaked in the barrels A, B and C. In the baths A, B and C, the barrels 61 are continuously rotated by the chain 95 and the others, so that the works in the barrels are stirred. The works are accommodated in spaces inside the barrels 61 lower than the openings 64. After these treatment, the carrier bar assembly 67 is put on the saddles 77 of the arms 76. Then, the barrels 61 are inclined together with the arms 76, the barrels 61 are rotated by the gears 84, 84' and others, and the works are discharged from the barrels 61.

Although the invention has been described in its preferred form with a certain degree of particularity, it is understood that the present disclosure of the preferred form may been changed in the details of construction and the combination and arrangement of parts may be resorted to without departing from the spirit and scope of the invention as hereinafter claimed.

What is claimed is:

1. A barrel plating apparatus in which a barrel accommodating a large number of works is successively soaked in a plurality of baths filled with treatment liquid, said barrel comprising a peripheral wall, a pair of end walls at opposite ends of the peripheral wall, an opening for loading and unloading said works provided at a central portion of at least one of said end walls without a cover or a cap, and a space for accommodating the works which is formed by a space lower than the opening inside the barrel when the central longitudinal axis of the barrel is horizontal, and said apparatus comprising a holding mechanism for holding the barrel, a supporting mechanism capable of supporting and moving the holding mechanism between an inclined and a horizontal position in which said central longitudinal axis is inclined and horizontal, respectively, means for horizontally transferring the supporting mechanism successively along said plurality of baths, a lifting mechanism for vertically moving the supporting mechanism, a rotating mechanism for rotating the barrel in a horizontal position about said central longitudinal axis in a treating position within a bath, and an inclining mechanism for inclining the holding mechanism and the central longitudinal axis of the barrel for operably unloading the works from the barrel through said at least one opening.

2. An apparatus as claimed in claim 1 wherein said both end walls of the barrel have the openings and cylindrical outer peripheral surfaces around the openings, which are rotatably supported by said holding mechanism.

3. An apparatus as claimed in claim 1 wherein one of the end walls of the barrel is provided at the outer periphery with a gear, and said rotating mechanism includes a gear mechanism for driving said gear on the end wall.

4. An apparatus as claimed in claim 1 wherein said both end walls of the barrel have the openings and cylindrical outer peripheral surfaces around the openings, said holding mechanism includes arms for rotatably supporting said cylindrical outer peripheral surfaces, one of the end walls of the barrel is provided at the outer periphery with a gear, said rotating mechanism includes a gear mechanism for driving said gear on the end wall, said supporting mechanism supports the holding mechanism by means of a horizontal support shaft perpendicular to the center line of the barrel, said lifting mechanism includes a frame for rigidly supporting the supporting mechanism, a vertical column for vertically guiding the frame, and a horizontally elongated elevator beam operable to move vertically and engage with the frame, and said inclining mechanism includes a driving mechanism for rotating said horizontal support shaft to a predetermined angular position.

5. An apparatus as claimed in claim 1, wherein said holding mechanism is rigidly fixed to said supporting mechanism, and said supporting mechanism is rotatably supported by said lifting mechanism through a horizontal support shaft perpendicular to the center line of the barrel.

6. An apparatus as claimed in claim 1 wherein said holding mechanism includes a pair of parallel spaced horizontal bars extending perpendicularly to the center line of the barrel and pairs of arms extending downwardly from the bars, said pairs of the arms rotatably support the barrels, respectively, said rotating mechanism includes a gear mechanism for driving a gear arranged on one of the end walls of each barrel, said supporting mechanism includes arms on which the ends of a pair of said bars are seated, and a frame for rotatably supporting said arms members through support shafts which are parallel to said bars and are rigidly fixed to the arms, and said inclining mechanism includes a driving mechanism for rotating said support shaft to a predetermined angular position.

* * * * *